US011238837B2

(12) United States Patent
Pirquet

(10) Patent No.: US 11,238,837 B2
(45) Date of Patent: Feb. 1, 2022

(54) TUNING MACHINE FOR STRINGED INSTRUMENTS

(71) Applicant: David Dunwoodie, Delta (CA)

(72) Inventor: Oliver Johann Pirquet, Victoria (CA)

( * ) Notice: Subject to any disclaimer, the term of this patent is extended or adjusted under 35 U.S.C. 154(b) by 28 days.

(21) Appl. No.: 16/609,911

(22) PCT Filed: Apr. 27, 2018

(86) PCT No.: PCT/CA2018/050499
§ 371 (c)(1),
(2) Date: Oct. 31, 2019

(87) PCT Pub. No.: WO2018/201234
PCT Pub. Date: Nov. 8, 2018

(65) Prior Publication Data

US 2020/0202820 A1 Jun. 25, 2020

Related U.S. Application Data

(60) Provisional application No. 62/492,335, filed on May 1, 2017.

(51) Int. Cl.
*G10D 3/14* (2020.01)

(52) U.S. Cl.
CPC ..... *G10D 3/14* (2013.01)

(58) Field of Classification Search
CPC ..... G10D 3/14
USPC ..... 84/306
See application file for complete search history.

(56) References Cited

U.S. PATENT DOCUMENTS

| | | | | |
|---|---|---|---|---|
| 1,710,802 A | | 4/1929 | Page | |
| 3,830,132 A | * | 8/1974 | Lowe | G10D 3/14 84/304 |
| 2002/0026864 A1 | * | 3/2002 | Gotoh | G10D 3/14 84/304 |

* cited by examiner

*Primary Examiner* — Jianchun Qin

(57) ABSTRACT

A tuning machine for a stringed instrument comprising an input shaft having an eccentric at an end and being rotatable by a user, a gear member with a central axial bore to receive the eccentric to move the gear member though an eccentric circular motion as the input shaft rotates, the gear member having external teeth, a ring gear having internal teeth positioned around the external teeth of the gear member, the ring gear accommodates the gear member such that at least one of the external teeth meshes with and drives at least one of the internal teeth as the gear member moves through its eccentric circular motion to rotate the ring gear about its central axis, and a string post driven by the ring gear to wind or unwind a string of the instrument as a result of rotation of the input shaft.

17 Claims, 5 Drawing Sheets

TUNING MACHINE FOR STRINGED INSTRUMENTS

BACKGROUND OF THE INVENTION

Field of Invention

This invention relates to a machine head or tuning machine for tuning stringed musical instruments, particularly to a tuning machine for ukuleles, guitars, banjos, or similar stringed instruments.

Description of Related Art

Stringed musical instruments typically provide a fixed anchor on one end of each string and a mechanism on the other end which allows a user to establish a select amount of tension in the string. The frequency at which the string oscillates depends greatly on, among several other parameters, the vibrating length of the string and its tension. A geared mechanical mechanism used to adjust the tension of the string is often referred to as a tuning machine or machine head. Tuning machines are well known in the art, and a typical tuning machine used on guitars, banjos and the like comprise a tuning handle secured to an end of a worm shaft which extends through a housing. A worm wheel is meshed with the worm shaft inside the housing, and a cylindrical post is connected to the worm wheel and aligned with the rotational axis of the worm wheel. The cylindrical post extends through a hole in the headstock of the instrument to the same side as the strings and is aligned such that its axis is generally perpendicular to the strings. In operation, as the handle (hence worm shaft) is rotated, it rotates the worm wheel, hence the cylindrical post. By this a guitar string that is inserted through a guitar string insertion hole defined in the cylindrical post is wound or unwound on or from the cylindrical post, thereby increasing or decreasing the string tension to effect tuning of the string.

There are numerous commercially available tuning machines of various designs, but most have the above common features and functions, and most are manufactured of primarily of metal. Nevertheless, there is a need for a simple, light weight and cost-effective tuning machine that can be used on small stringed instruments, such as ukuleles for example, without adding a lot of weight to the headstock, and that can be economically mass produced at low cost.

SUMMARY OF THE INVENTION

Accordingly, in some embodiments, the present invention provides a tuning machine for a stringed instrument comprising: an input shaft having a first end, and an opposite second end having an eccentric, the input shaft being rotatable in response to an input from a user; a gear member with a central axial bore to receive the eccentric to move the gear member though a circular motion as the input shaft rotates, the gear member having external teeth; a ring gear having internal teeth positioned around the external teeth of the gear member, the ring gear being larger than the gear member to accommodate the circular motion of the gear member within the ring gear such that at least one of the external teeth meshes with and drives at least one of the internal teeth as the gear member moves through its circular motion to rotate the ring gear about its central axis; and a string post driven by the ring gear to wind a string of the instrument as a result of rotation of the input shaft in one direction and unwind the string as a result of rotation of the input shaft in an opposite direction.

In some embodiments, the apparatus may further comprise a limiting mechanism that interferes with the gear member to limit rotation of the gear member about its central axis.

In some embodiments, the external teeth may be convex and capable of meshing with complementarily concave grooves between the internal teeth.

In some embodiments, the gear member may have at least one fewer external teeth than the internal teeth of the ring gear.

In some embodiments, the gear member may have one or two fewer external teeth than the internal teeth of the ring gear.

In some embodiments, the string post may be connected to the ring gear coaxially with the central axis of the ring gear.

In some embodiments, the apparatus may further comprise a housing for mounting on the stringed instrument, the housing defining a bore and the input shaft being journaled for rotation in the bore, and the housing further defining a cavity to accommodate the gear member and the ring gear.

In some embodiments, the housing may include a base portion having a bottom surface for mounting on the stringed instrument, wherein the cavity may be defined in the base portion and may be open to the bottom surface, the housing may further include a top wall opposite the bottom surface that delimits the cavity, and wherein the bore is defined in the top wall.

In some embodiments, the limiting mechanism may comprise a void defined in the top wall and a projection on the gear member that travels within the void, and the void confines the travel of the projection to a range of motion that permits the circular motion of the gear member but does not permit rotation of the gear member about its central axis.

In some embodiments, the limiting mechanism may comprise voids defined in the top wall and arranged around the bore and projections on the gear member, wherein each projection travels within an adjacent void, and the voids confine the travel of the projections to a range of motion that permits the circular motion of the gear member but does not permit rotation of the gear member about its central axis.

In some embodiments, the apparatus may further include a handle connected to the first end of the input shaft to facilitate a user to impart rotation to the input shaft.

In some embodiments, the present invention provides a tuning machine for stringed instruments that comprises a handle connected to an input shaft that has an eccentric at the end opposite the handle, the eccentric drives a disc in an eccentric circle, and as the disc travels through its eccentric circle, it drives an internal ring gear. The internal ring gear is connected to an output shaft that is connected to a string post and as the output shaft rotates, the string is wound or unwound onto the string post.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings, which illustrate by way of example only embodiments of the invention.

DETAILED DESCRIPTION

Figure 1:
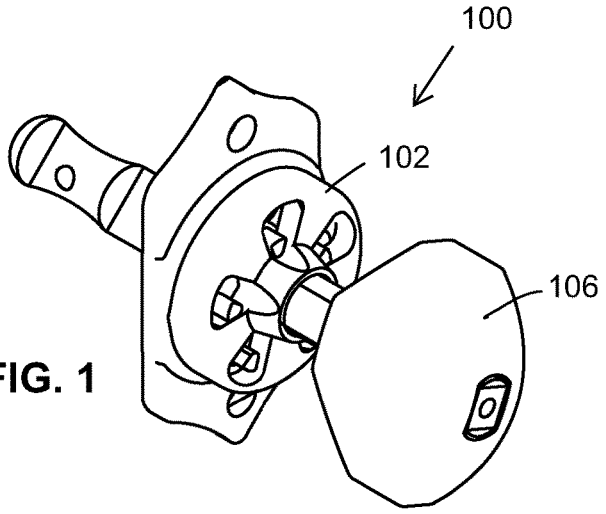
FIG. 1 is a perspective view of a tuning machine or tuning machine in accordance with an embodiment of the present invention.
Figure 2:
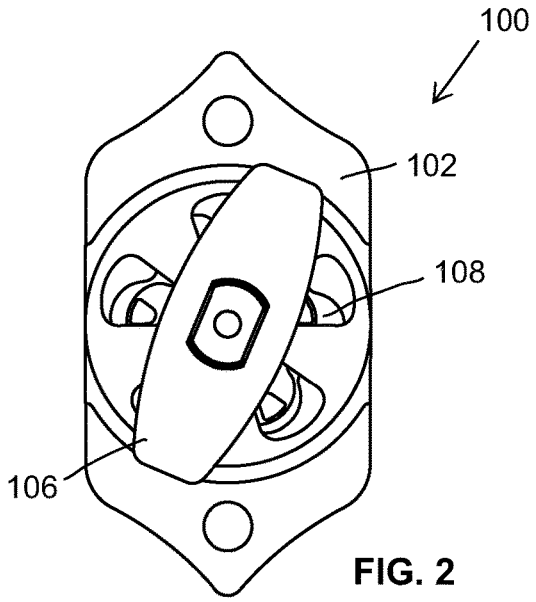
FIG. 2 is a top view of the tuning machine of FIG. 1.
Figure 3:
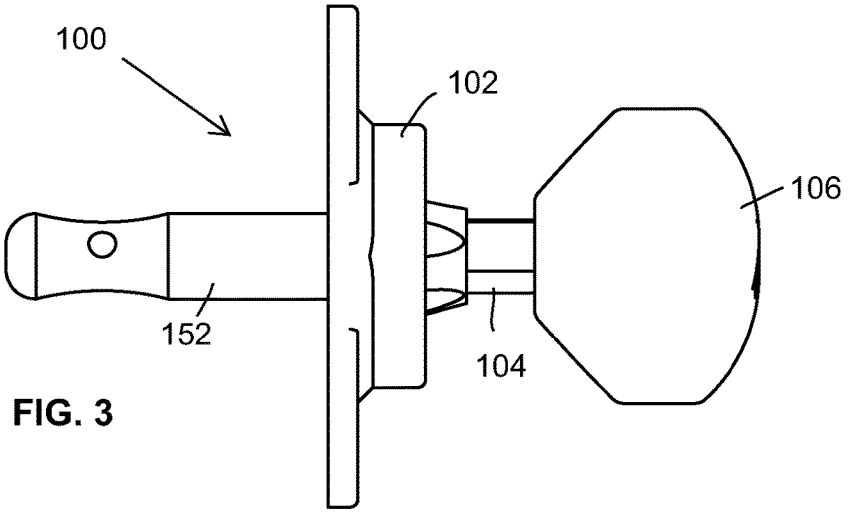
FIG. 3 is a side view of the tuning machine of FIG. 1.
Figure 4:
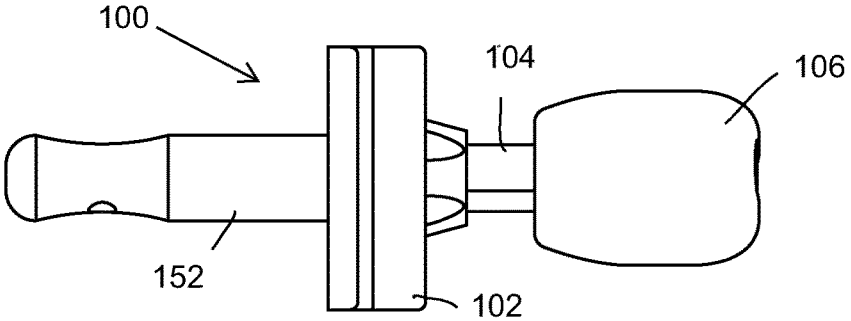
FIG. 4 is a front view of the tuning machine of FIG. 1.
Figure 5:
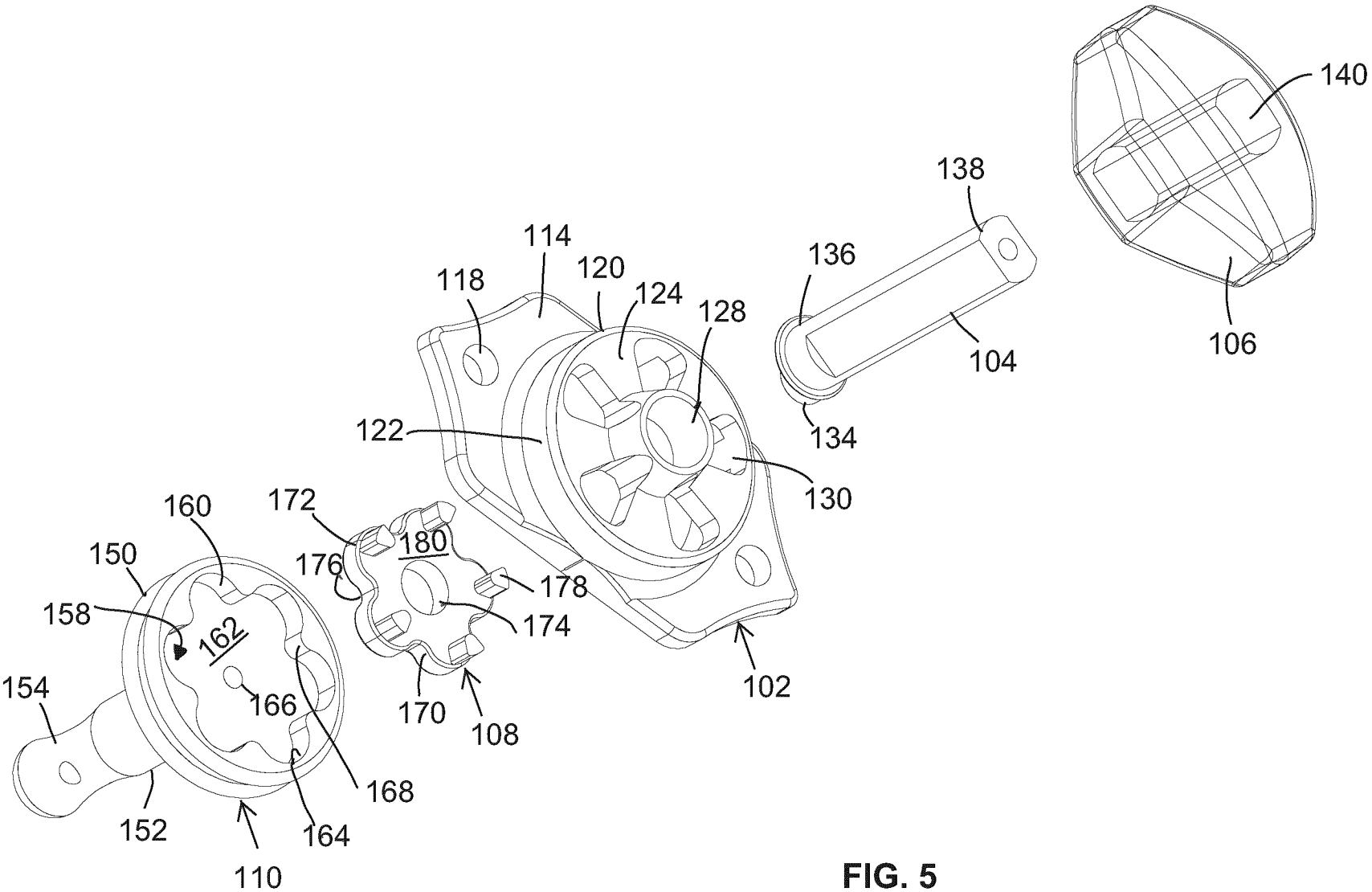
FIG. 5 is an exploded perspective view from the top of the tuning machine of FIG. 1.
Figure 6:
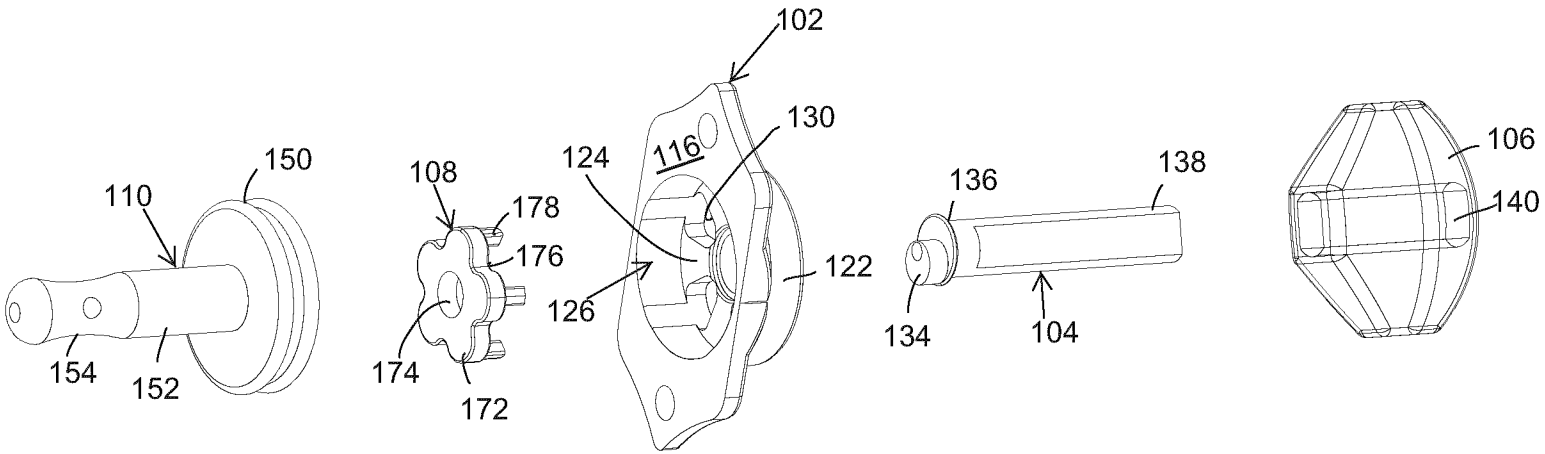
FIG. 6 is an exploded perspective view from the bottom of the tuning machine of FIG. 1.

For the purposes of promoting an understanding of the principles of the invention reference will now be made to the exemplary embodiment illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one, skilled in the relevant art and having possession of this disclosure, are to be considered within the scope of the invention.

Referring to FIGS. 1-8, there is shown a tuning machine or tuning machine 100 in accordance with a first embodiment of the present invention that can be mounted on the headstock of a stringed instrument, such as for example a guitar, banjo, ukulele, and the like. Tuning machine 100 comprises housing 102, input shaft 104, handle 106, gear member or disc 108 and internal ring gear member 110.

Housing 102 includes a base portion 114 having a flat surface 116 adapted to abut a flat surface on the headstock of stringed instrument. Base portion 114 includes one or more mounting holes 118 to receive fasteners such as screws for affixing the housing 102 to the headstock. Housing 102 further includes a raised portion 120 having circumferential sidewall 122 and top wall 124 that together define an internal cavity such as circular cavity 126. The top wall 124 includes central bore 128 and one or more trapezoidal openings 130.

Input shaft 104 has a first end 138 and an opposite second end 136 having an eccentric 134. It should be understood by the reader that an eccentric is a circular disk or pin fixed to a rotating axle with its centre offset from that of the axle. At the first end 138 the input shaft 104 is connected to handle 106 by being shaped to be received within a generally rectangular axial bore 140 that passes through the handle 106 so that the handle 106 and the end 138 of the input shaft 104 can be said to have a key fit. The end 136 of the input shaft is journaled for rotation within the central bore 128 of the housing 102 in a manner that the eccentric 134 extends into the cavity 126. Accordingly, turning handle 106 rotates the eccentric 134 within cavity 126. In this manner, the input shaft is rotatable in response to an input from a user; however, other user input mechanisms for rotating the input shaft will henceforth be apparent to the skilled reader.

Tuning machine 100 further includes a ring gear. In the illustrated embodiment, the ring gear is part of ring gear member 110 that comprises disc portion 150 shaped and configured to be received within the internal cavity 126 of the housing 102, and an output shaft 152 perpendicular to the disc portion that functions as a string post and includes a string winding portion 154 upon which an end of a string of the instrument is wound. Accordingly, the string post is driven by the ring gear: in the illustrated embodiment by being directly connected to the ring gear. However, in some embodiments the string post may be indirectly coupled to the ring gear, such as for example by intermediate gears, so as to be driven by the ring gear.

Disc portion 150 defines a gear cavity 158 in a top surface that includes internal circumferential gear portion 160 and an internal planar surface 162. The internal gear portion 160 comprises a plurality of semicircular grooves 164 located radially about a center 166, which coincides with the longitudinal axis of output shaft 152. The transition zones or teeth 168 between adjacent semicircular grooves 164 are rounded. Accordingly, the disc portion 150 with the gear cavity 158, the internal gear portion 160 with the grooves 164 and teeth 168 are embodiments of a ring gear having internal teeth.

With a tuning machine 100 mounted on the headstock of the instrument, the output shaft 152 of the ring gear member 110 passes through an opening in headstock as is common in the art, and the disc portion 150 is received and caged within the internal cavity 126 of the housing 102 with the housing fastened to the headstock such that the disc portion 150 is rotatable in a planar motion within the internal cavity 126.

Figure 7:
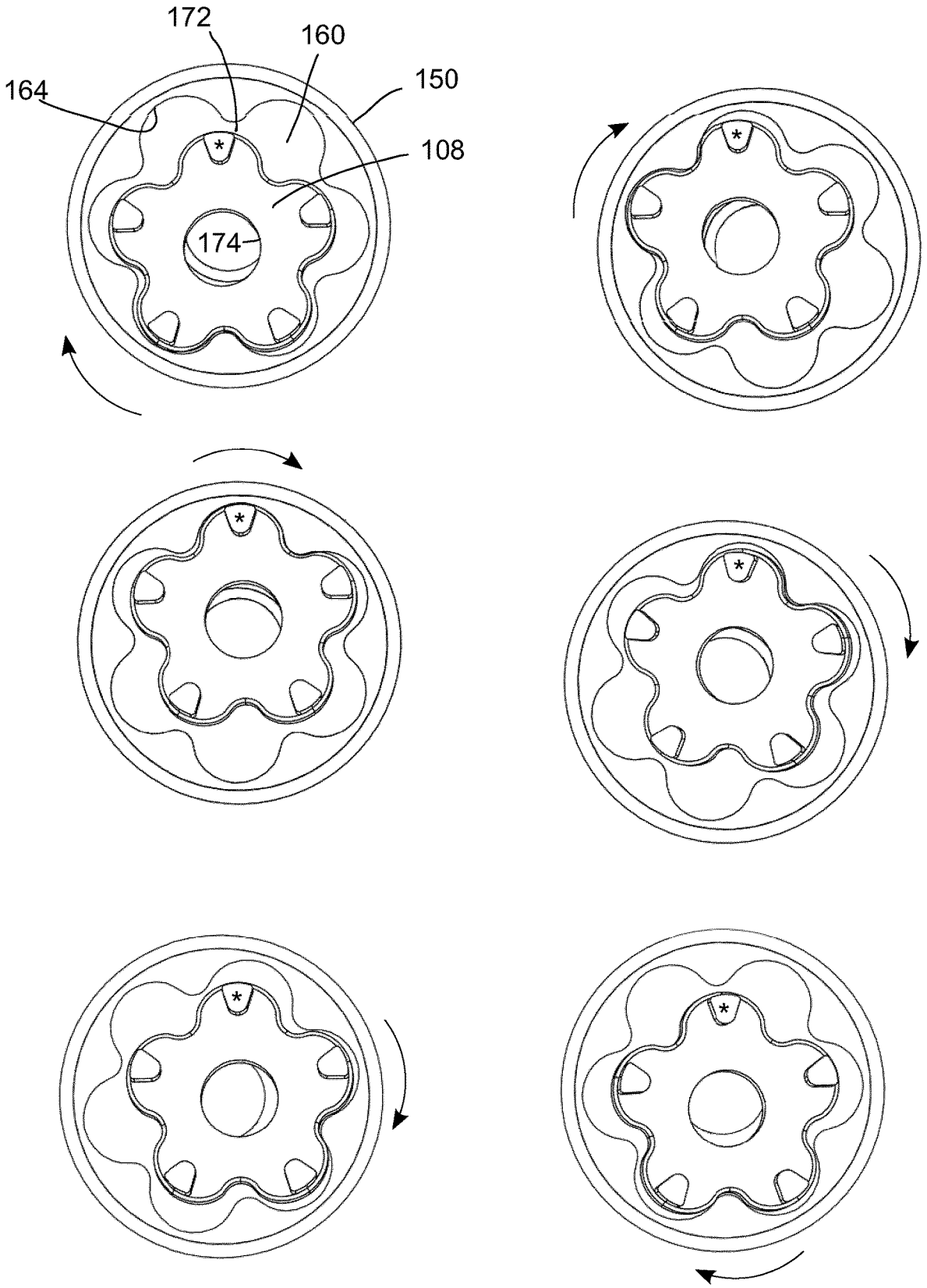
FIG. 7 is a series of top plan views of the disc within the internal gear portion of the tuning machine of FIG. 1.

Gear member such as disc 108 defines an edge having an external circumferential gear portion 170 comprising a plurality of semicircular teeth 172 located radially about central axial bore 174. Transition zone 176 between adjacent teeth is concave. The disc 108 is configured to fit within the internal gear portion 160 of the disc portion 150 of the ring gear member 110. The teeth 172 of the disc are sized and shaped to mesh with the semicircular grooves 164 of the internal gear portion 160, as shown in FIG. 7. Accordingly, the ring gear is larger than the gear member to accommodate the eccentric circular motion of the gear member within the ring gear such that at least one of the external teeth of the gear member meshes with and drives at least one of the internal teeth of the ring gear as the gear member moves through its eccentric circular motion to rotate the ring gear about its central axis.

The number of teeth 172 on disc 108 is at least one less, and may be two less, than the number of semicircular grooves 164 on the disc portion 150. As will be explained herein, the number of semicircular grooves 164 determines the gear ratio of the tuning machine 100. In the illustrated embodiment, the ring gear member 110 has six semicircular grooves and the disc 108 has five semicircular teeth 172. Accordingly, the gear member has at least one fewer external teeth than the internal teeth of the ring gear. Preferably the gear member has one or two fewer external teeth than the internal teeth of the ring gear. Preferably the gear member has one fewer external teeth than the internal teeth of the ring gear.

In the assembled tuning machine 100, the disc 108 is received within the gear cavity 158 of the disc portion 150 of the ring gear member 110, and the disc portion 150 is received within the internal cavity 126 of the housing 102, which is mounted onto the headstock of the stringed instrument. The central bore 174 of the disc 108 receives the eccentric 134 of the input shaft 104, which is journaled to rotate within bore 128 at end 136 and connected to the handle 106 at end 138. Accordingly, in the assembled tuning machine 100, rotation of the input shaft 104 via handle 106 causes the disc 108 to move in a planar eccentric circular manner within the gear cavity 158.

Figure 8:
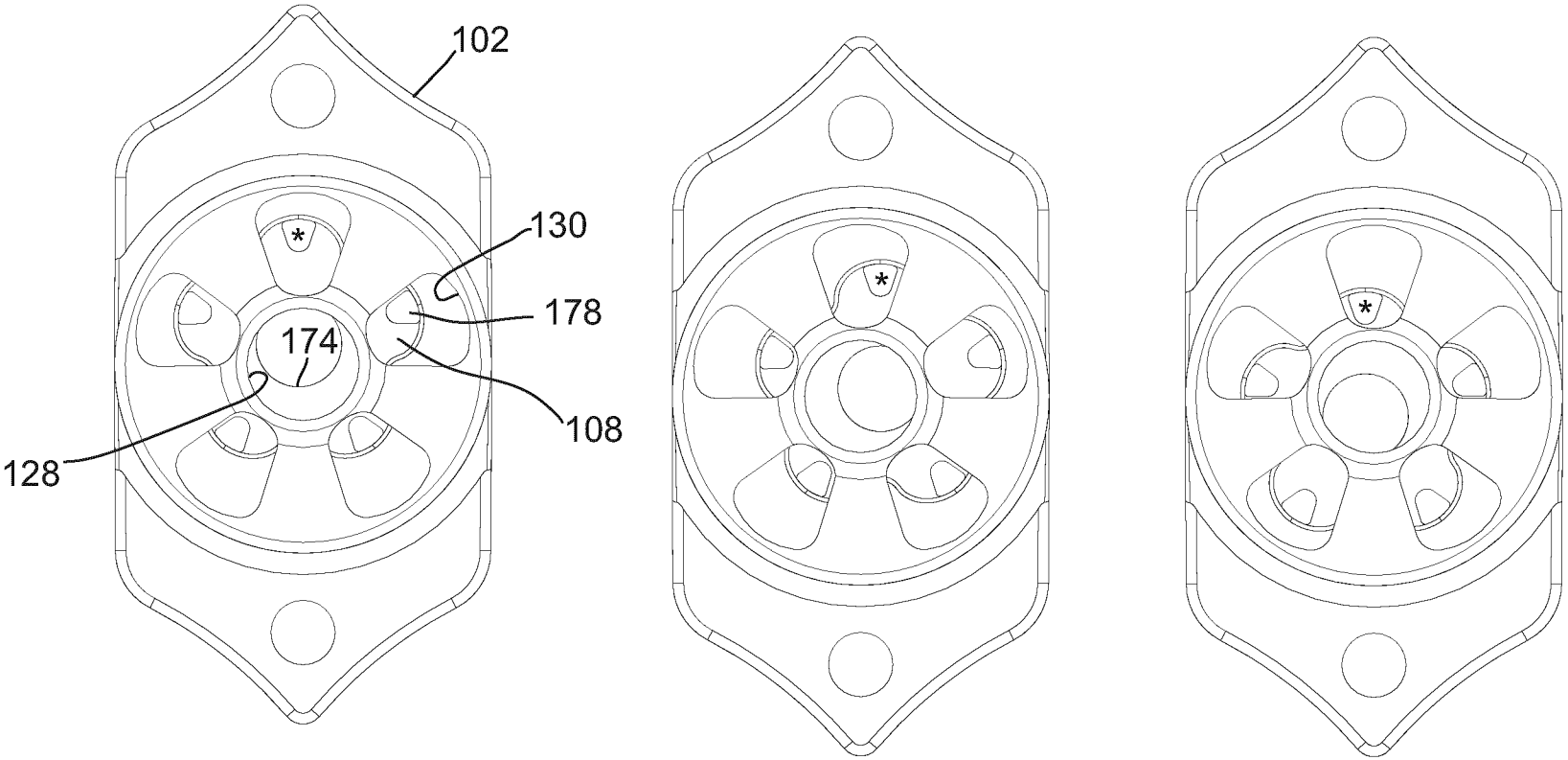
FIG. 8 is a series of top plan views of the disc within the housing of the tuning machine of FIG. 1.

Tuning machine 100 may further include a limiting mechanism that interferes with the gear member to limit rotation of the gear member about its central axis. In the illustrated embodiment, the limiting mechanism comprises one or more projections or pins 178 on the surface 180 of the disc 108 that faces the inside of top wall 124 on the housing 102, and the pins 178 are configured to be received within the voids or openings 130 in a manner that the pins 178 have a freedom of movement laterally within the openings to the extent of the circle of motion defined by the eccentric movement of the disc 108, but the pins 178 are constrained by the wall of the openings 130 so that the disc 108 is not able to rotate completely about its central axis (as best shown in FIG. 8). The disc 108 thus maintains its angular relationship to the disc portion of the housing while undergoing circular planar motion with respect to the disc portion. The internal ring gear member—hence the output shaft—is forced to rotate, changing its angular relationship to the disc. It is preferable to have a limiting mechanism to impede rotation of the disc 108, which results in the ring gear, hence string post, turning in the same direction as the input shaft for a more natural tuning experience for the user.

Referring to FIG. 7, there is shown disc 108 within the gear cavity 158 in several positions throughout its eccentric circular motion as the disc is driven by the eccentric 134 on the input shaft 104. For simplicity, only the top of the disc portion 150 of the ring gear member 110 and the disc 108, received within the gear cavity 158, are shown. The disc 108 is driven by eccentric 134 via central bore 174 of the disc such that the center of the disc moves in a circle, but the disc itself does not rotate to any great degree since it's rotation is limited by the range of movement of the pins 178 traveling within the openings 130 of the housing, as described above. This is illustrated by designating one of the pins 178 on a tooth 172 with the symbol * to show that it remains in the same region and does not rotate. As the disc travels through its circular range of motion, one or more of semicircular teeth 172 engages an adjacent semicircular groove 164 of the internal gear portion 160 and causes the internal gear portion (hence the output shaft 152) to rotate through an arc of rotation in the direction of the circular movement of the disc. As the disc 108 continues to move through its circular motion, the various teeth 172 engage and disengage with adjacent semicircular grooves 164, causing the internal gear portion 160 to rotate through an arc of rotation with each successive engagement between the semicircular teeth on the disc and the semicircular grooves on internal gear portion. Reversing the rotation of the input shaft reverses the rotation of the ring gear, hence also reversing the rotation of the string post. Accordingly, the string post is driven by the ring gear to be able to wind a string of the instrument as a result of rotation of the input shaft in one direction and unwind the string as a result of rotation of the input shaft in an opposite direction.

The movement of the disc 108 through a complete circle of motion causes the rotation of the internal gear portion 160 through an arc of rotation, the value of which depends on the gear ratio and is determined by the number of grooves 164 on the internal gear. For example, in the illustrated embodiment in which the internal gear has six grooves 164, the rotation of the internal gear 160 that results from a complete circular movement of the disc would be ⅙ of a complete revolution of the internal gear. Hence the gear ratio in such an embodiment would be 6:1 meaning that six complete revolutions of the high-speed input shaft are required to produce one complete revolution of the internal gear portion 160, hence the output shaft 152 on which the string of the instrument is wound. The gear ratio of the tuning machine 100 may be selected by altering the number of grooves 164 on internal gear. For example, a gear ratio of 8:1 may be obtained by providing eight semicircular grooves 164 on the internal gear portion 160 and seven semicircular teeth 172 on the disc. Similarly, a gear ratio of 12:1 may be obtained with twelve semicircular grooves on the gear portion and eleven semicircular teeth on the disc. Hence a gear ratio of n:1 may be obtained with n number of semicircular grooves on the gear portion and n−1 semicircular teeth on the disc. Preferably the number of teeth 172 on the disc is not more than two teeth less than the number of grooves 164 on the internal gear member. The effect of having two less teeth on the disc than the grooves on the internal gear would result in having a reduced gear ratio. Such that rather than internal ring gear 160 advancing one groove per cycle of the disc, the internal ring gear would advance two teeth. The effect on the teeth interaction would result in greater sliding motion between the disc and the ring gear, which would tend to reduce the efficiency of the drive, losses being accounted for by the increased friction between the disc and ring gears. Practically it would be difficult to design a disc with two fewer teeth on a small gear ratio drive because there would be problems with the meshing of the teeth due to the large difference in diameter, as well as the larger angular displacement of the output drive per tooth engagement.

In general, the gear mechanism of the tuning machine 100 of the present invention is similar to a cycloidal drive mechanism but in which the disc 108 is prevented from rotating and the internal gear 160 or ring gear is free to rotate. Thereby, the eccentric circular motion of the disc 108 causes the internal gear portion 160 to rotate and drive the output shaft or string post. In typical cycloidal drive mechanisms in which the disc is allowed to revolve and the ring gear is fixed, the resulting output shaft rotation is counter to the rotation of the input shaft. While this works in some embodiments of the tuning machine of the present invention, it would be awkward for many musicians of stringed instruments who are habituated to the prior art tuning machines in which the string post rotates in the same direction as the handle. Accordingly, with the illustrated embodiment of tuning machine of the present invention, by preventing rotation of the disc 108 about its central axis using the liming mechanism of the pins 172 in the openings 130 in the housing 102, the resulting rotation of the output shaft is in the same direction as the rotation of the handle 106, making it unnecessary for the user to become re-accustomed to the string tensioning direction of the tuning machines or for additional corrective gearing. In either gear configuration, the method of developing the profiles of the disc teeth and internal gear teeth (and grooves) follows the principles of cycloidal gear tooth design as is known in the art.

The advantageous aspect of the tuning machines of the present invention is that the simplicity of the parts makes them highly amenable to being economically mass-produced out of plastic, metal or both by methods such as casting, injection molding, 3D printing techniques or simple machining. The gear parts in the present invention may have larger variability in dimensions such they may be made to less precise dimensions without impairing function, which makes it possible to manufacture them to less stringent dimensional specifications using economical mass production methods. For example, the parts of the tuning machine of the present invention may be made by injection molding plastics, which results in light weight and cost effective tuning machines that can be used on small stringed instruments (such as ukuleles) or on stringed instruments that typically have large tuning machines (such a bass guitars), and achieve a significant weight reduction in contrast to comparable prior art metal tuning machines. In some embodiments, the tuning machines may include metal portions for structural reinforcement, such as for example a metal rod core in the output shaft/string post, and these can be readily incorporated in a plastic injection molding process. In addition, advantageously the gear mechanism of the present invention cannot be driven by the output shaft. Hence the rotation force caused by string tension on the output shaft does not reverse the gear mechanism to result in unwinding of the string. The gear mechanism may only be driven by the turning of the input shaft by the handle or otherwise. Other benefits of the present invention are that there may be reduced backlash in the gear mechanism, and because of the simplicity in the gear structure, it is quite simple to design tuning machines of a variety of gear ratios from high to low ratios, including gear ratios that are quite low for tuning machines for these kinds of stringed instrument, such as 3:1.

While the above description and illustrations constitute preferred or alternate embodiments of the present invention, it will be appreciated that numerous variations may be made without departing from the scope of the invention. Thus, the embodiments described and illustrated herein should not be considered to limit the invention as construed in accordance with the accompanying claims.

The invention claimed is:

1. A tuning machine for a stringed instrument comprising:

an input shaft having a first end, and an opposite second end having an eccentric with a centre offset from a central axis of the input shaft, the input shaft being rotatable in response to an input from a user;

a gear member with a central axial bore to receive the eccentric to move the gear member though an eccentric circular motion as the input shaft rotates, the gear member having external teeth;

a ring gear having internal teeth positioned around the external teeth of the gear member, the ring gear being larger than the gear member to accommodate the eccentric circular motion of the gear member within the ring gear such that at least one of the external teeth meshes with and drives at least one of the internal teeth as the gear member moves through its eccentric circular motion to rotate the ring gear about its central axis; and a string post driven by the ring gear to wind a string of the instrument as a result of rotation of the input shaft in one direction and unwind the string as a result of rotation of the input shaft in an opposite direction.

2. The apparatus as claimed in claim 1, further comprising a limiting mechanism that interferes with the gear member to limit rotation of the gear member about its central axis.

3. The apparatus as claimed in claim 2, wherein the external teeth are convex and are capable of meshing with complementarily concave grooves between the internal teeth.

4. The apparatus as claimed in claim 3, wherein the gear member has at least one fewer external teeth than the internal teeth of the ring gear.

5. The apparatus as claimed in claim 3, wherein the gear member has one or two fewer external teeth than the internal teeth of the ring gear.

6. The apparatus as claimed in claim 4, wherein the string post is connected to the ring gear coaxially with the central axis of the ring gear.

7. The apparatus as claimed in claim 6, further comprising a housing for mounting on the stringed instrument, the housing defining a bore and the input shaft being journaled for rotation in the bore, and the housing further defining a cavity to accommodate the gear member and the ring gear.

8. The apparatus as claimed in claim 6, further including a handle connected to the first end of the input shaft to facilitate a user to impart rotation to the input shaft.

9. The apparatus as claimed in claim 7, wherein the housing includes a base portion having a bottom surface for mounting on the stringed instrument, wherein the cavity is defined in the base portion and is open to the bottom surface, the housing further including a top wall opposite the bottom surface that delimits the cavity, and wherein the bore is defined in the top wall.

10. The apparatus as claimed in claim 9, wherein the limiting mechanism comprises a void defined in the top wall and a projection on the gear member that travels within the void, and the void confines the travel of the projection to a range of motion that permits the eccentric circular motion of the gear member but does not permit rotation of the gear member about its central axis.

11. The apparatus as claimed in claim 10, further including a handle connected to the first end of the input shaft to facilitate a user to impart rotation to the input shaft.

12. The apparatus as claimed in claim 9, wherein the limiting mechanism comprises voids defined in the top wall and arranged around the bore and projections on the gear member, wherein each projection travels within an adjacent void, and the voids confine the travel of the projections to a range of motion that permits the eccentric circular motion of the gear member but does not permit rotation of the gear member about its central axis.

13. The apparatus as claimed in claim 12, further including a handle connected to the first end of the input shaft to facilitate a user to impart rotation to the input shaft.

14. The apparatus as claimed in claim 2, further comprising a housing for mounting on the stringed instrument, the housing defining a bore and the input shaft being journaled for rotation in the bore, and the housing further defining a cavity to accommodate the gear member and the ring gear.

15. The apparatus as claimed in claim 14, wherein the housing includes a base portion having a bottom surface for mounting on the stringed instrument, wherein the cavity is defined in the base portion and is open to the bottom surface, the housing further including a top wall opposite the bottom surface that delimits the cavity, and wherein the bore is defined in the top wall.

16. The apparatus as claimed in claim 15, wherein the limiting mechanism comprises a void defined in the top wall and a projection on the gear member that travels within the void, and the void confines the travel of the projection to a range of motion that permits the eccentric circular motion of the gear member but does not permit rotation of the gear member about its central axis.

17. The apparatus as claimed in claim 15, wherein the limiting mechanism comprises voids defined in the top wall and arranged around the bore and projections on the gear member, wherein each projection travels within an adjacent void, and the voids confine the travel of the projections to a range of motion that permits the eccentric circular motion of the gear member but does not permit rotation of the gear member about its central axis.

* * * * *